US011118405B2

(12) United States Patent
Tuttle

(10) Patent No.: US 11,118,405 B2
(45) Date of Patent: Sep. 14, 2021

(54) ECCENTRIC DUAL STRING EXIT MODULE

(71) Applicant: Elliot Tuttle, Anchorage, AK (US)

(72) Inventor: Elliot Tuttle, Anchorage, AK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/703,182

(22) Filed: Dec. 4, 2019

(65) Prior Publication Data

US 2021/0172255 A1 Jun. 10, 2021

(51) Int. Cl.
*E21B 29/06* (2006.01)
*E21B 7/06* (2006.01)

(52) U.S. Cl.
CPC ..... *E21B 7/061* (2013.01); *E21B 29/06* (2013.01)

(58) Field of Classification Search
CPC ..... E21B 7/061; E21B 29/06
USPC ..... 175/61
See application file for complete search history.

(56) References Cited

U.S. PATENT DOCUMENTS 5,474,126 A 12/1995 Lyned et al.
5,474,131 A 12/1995 Jordan, Jr. et al.
5,678,634 A 10/1997 Rehbock et al.
6,378,629 B1 * 4/2002 Baird ..... E21B 7/061 175/107
7,293,940 B1 11/2007 Perreau-Saussine et al.
8,505,622 B1 8/2013 Harris et al.
2002/0023754 A1 * 2/2002 Buytaert ..... E21B 41/0042 166/313

FOREIGN PATENT DOCUMENTS

EP 1405983 B1 3/2007

OTHER PUBLICATIONS

International Search Report and Written Opinion for International Application No. PCT/US2020/062674; International Filing Date Dec. 1, 2020; dated Mar. 9, 2021; 8 Pages.

* cited by examiner

*Primary Examiner* — Taras P Bemko
(74) *Attorney, Agent, or Firm* — Cantor Colburn LLP

(57) ABSTRACT

A method and device for drilling a lateral wellbore off of a main wellbore. The device includes a guide tube for guiding a drill string to a selected location in a wellbore, the guide tube configured to support a whipstock. One or more stabilizers maintains the guide tube at an eccentric position in the wellbore. The guide tube is disposed in the main wellbore with a contact side of the guide tube against the casing. The whipstock is conveyed through the guide tube to the selected location. The drill string is conveyed through the guide tube to the selected location. The drill string is directed via the whipstock to mill an exit window in the contact side of the guide tube and the casing, thereby drilling the lateral wellbore.

10 Claims, 3 Drawing Sheets

ECCENTRIC DUAL STRING EXIT MODULE

BACKGROUND

In the resource recovery industry, a wellbore is drilled from a surface location to a reservoir in the earth in order to obtain hydrocarbons therein. In various drilling operations, a vertical well is drilled from the surface and one or more lateral wells or horizontal wells can be drilled off of the original vertical well. A lateral well can be formed from a cased wellbore by lowering a whipstock into the casing and orienting the whipstock in a selected direction. A milling device that is lowered onto the whipstock is then diverted to one side to drilling through the casing. In current milling operations, directing the milling device to its desired orientation is an unstable operation. The milling device may need to exit through multiple strings and the completion configuration is sometimes setup in preparation for the milling operation. Therefore, there is a need to direct milling devices with greater accuracy.

SUMMARY

According to one embodiment, a method of drilling a lateral wellbore off of a main wellbore is disclosed. The method includes disposing a guide tube of an eccentric deflection device into a casing in the main wellbore with a contact side of the guide tube against the casing, conveying a whipstock through the guide tube to a selected location in the main wellbore for drilling the lateral wellbore, conveying a drill string through the guide tube to the selected location, and directing the drill string via the whipstock to mill an exit window in the contact side of the guide tube and the casing to drill the lateral wellbore.

According to another embodiment, an eccentric deflection device is disclosed. The device includes a guide tube for guiding a drill string to a selected location in a wellbore, the guide tube supporting a whipstock, and one or more stabilizers configured to maintain the guide tube at an eccentric position in the wellbore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
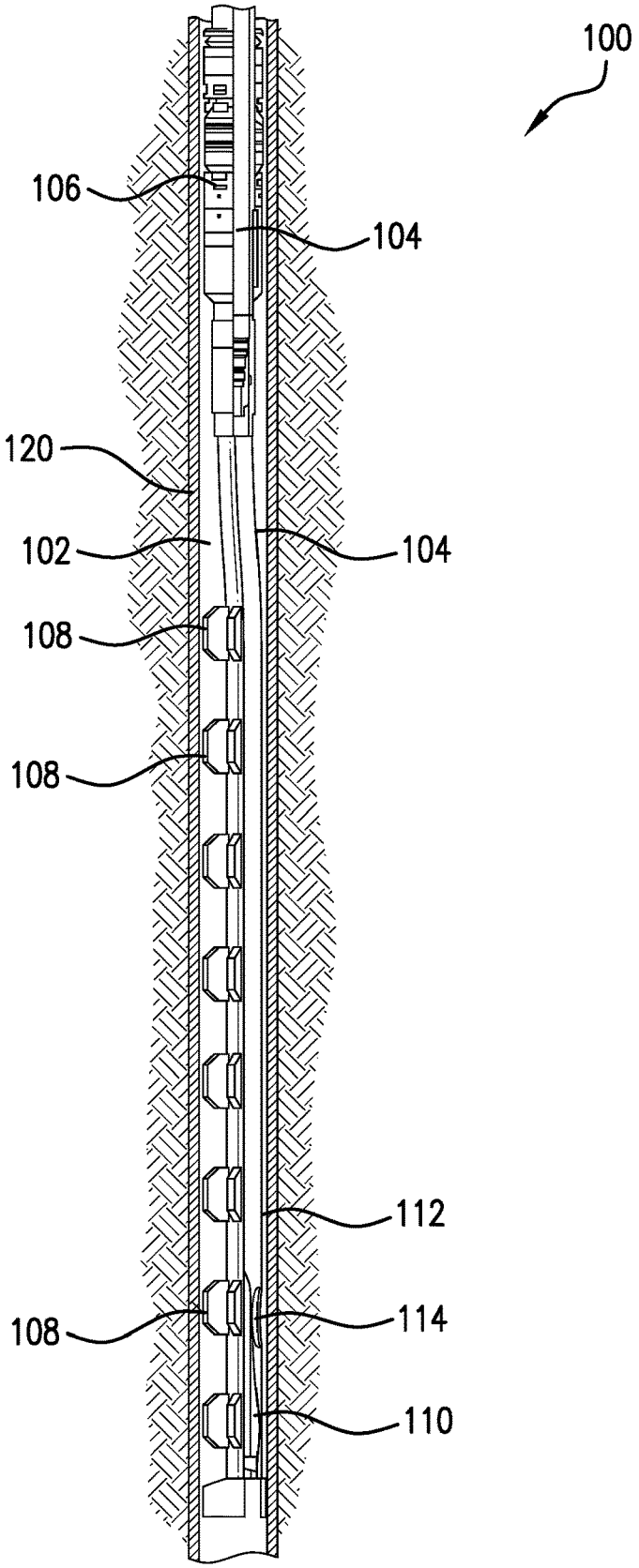
FIG. 1 shows an eccentric deflection device disposed in a main wellbore including a casing.

Referring to FIG. 1, an eccentric deflection device 100 is shown disposed in a main wellbore 102 including a casing 120. The eccentric deflection device 100 includes a tubing or guide tube 104 extending along a length of the eccentric deflection device 100. The guide tube 104 passes from an uphole location through a packer 106. Below the packer 106, the guide tube 104 includes stabilizers 108 that can be welded, fastened, molded and/or glued along one side of an exterior surface of the guide tube 104 in order to offset the guide tube 104 from a centered position within the main wellbore 102. When the eccentric deflection device 100 is placed in the main wellbore 102, the stabilizers 108 force the guide tube 104 into an eccentric position within the main wellbore 102 with respect to a longitudinal axis of the main wellbore 102. The dimensions of the stabilizers 108 are selected to make contact with the casing 120, thereby maintaining the guide tube 104 to one side of the main wellbore 102. A contact side 112 of the guide tube 104 (generally opposite the stabilizers 108) is therefore pressed against the casing 120. The contact side 112 of the guide tube 104 is either in direct contact with the casing 120 or has a minimal amount of space between the contact side 112 and the casing 120. A whipstock 110 is placed within the guide tube 104 in order to divert a milling device lowered in the contact side 112 of the guide tube 104. A profile 116 can be placed at a selection location of the eccentric deflection device 100 in order to support the whipstock 110 in the guide tube 104.

When the guide tube 104 has been lowered to a selected location or selected depth within the casing 120, a whipstock 110 is lowered to the selected depth in the guide tube 104. The whipstock 110 is oriented within the guide tube 104 in order to divert a drill string to the contact side 112 of the guide tube 104 as it is lowered into the guide tube 104. The drill string thereby drills an exit window 114 in the guide tube 104 and the casing 120. Since the exit window 114 is drilled in the contact side 112 of the guide tube, the milling device encounters little or no space between the guide tube 104 and casing 120. Due to this lack of space, the drill string encounters little if any instability as its passes from the guide tube 104 to the casing 120.

Figure 2:
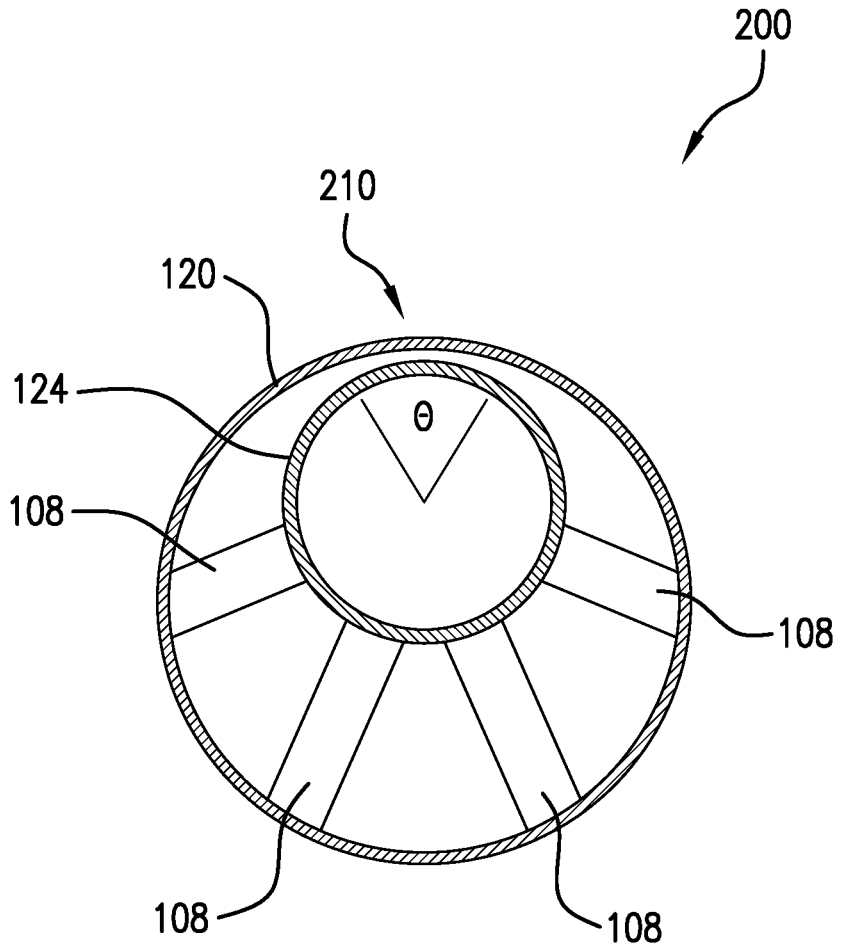
FIG. 2 shows a plan view along a longitudinal axis of the main wellbore.

FIG. 2 shows a plan view along a longitudinal axis of the main wellbore 102. The stabilizers 108 are dimensioned to force the guide tube 104 to an offset or eccentric position in the main wellbore 102 and to press contact side 112 of the guide tube 104 against the casing 120. The length of a selected stabilizers 108 is determined based on its circumferential location along the guide tube 104 and its orientation, as well as a diameter of the casing 120.

FIG. 2 shows an angular range θ over which the guide tube 104 is either in contact with the casing 120 or is separated from the casing 120 by less than a selected criterion. In one embodiment, the whipstock 110 is placed in the guide tube 104 along an orientation that directs a drill string to location 210 of maximal contact between the guide tube 104 and the casing 120. In an alternate embodiment, the whipstock 110 diverts the milling device to drill an exit window 114 at a location within the angular range θ.

Figure 3:
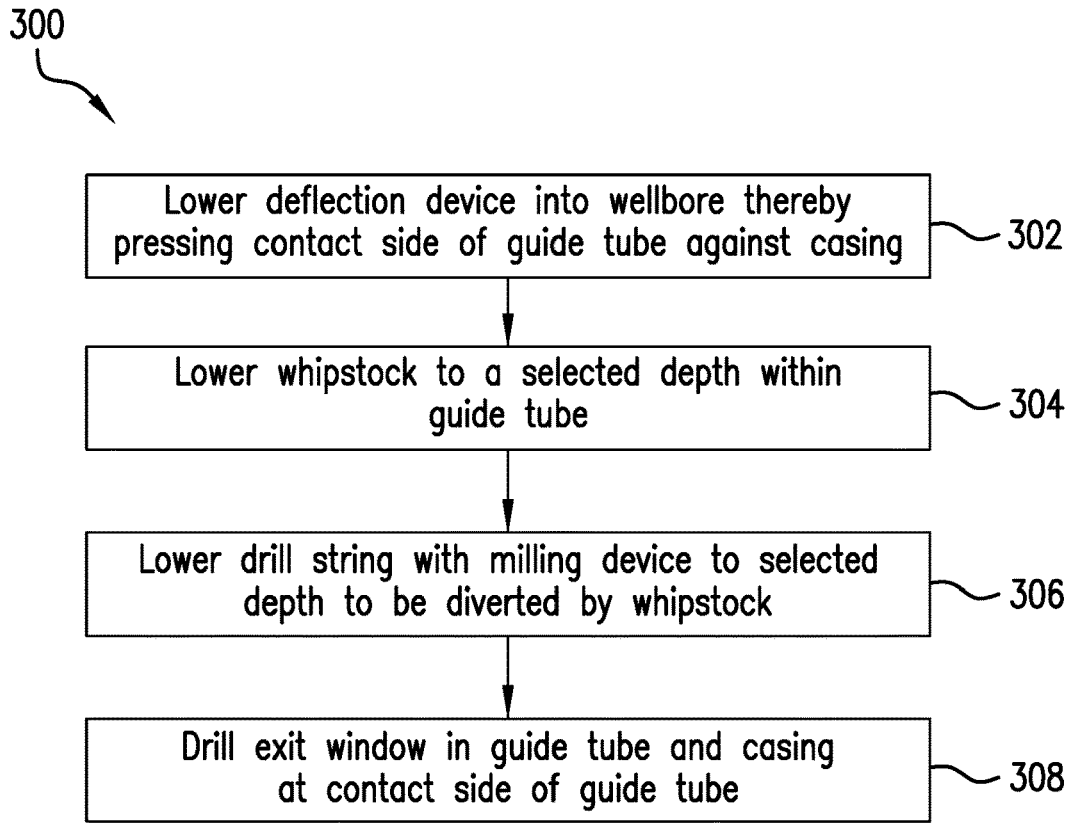
FIG. 3 shows a flowchart illustrating operation of the eccentric deflection device in various embodiments.

FIG. 3 shows a flowchart 300 illustrating operation of the eccentric deflection device in various embodiments. In box 302, the eccentric deflection device 100 is conveyed downhole as an enclosed tube, i.e., without an exit window 114 having been drilling along one side of the guide tube 104. The guide tube 104 is thus conveyed to a target location for drilling a lateral wellbore. In box 304, the whipstock 110 is lowered into the guide tube 104 at the target location. In box 306, the drill string and milling device is lowered into the guide tube 104 and diverted to the contact side 112 of the guide tube to 104 via the whipstock 110. In box 308, the milling device drills the exit window 114 in the wall of the contact side 112 of the guide tube 104 and the casing 120.

Figure 4:
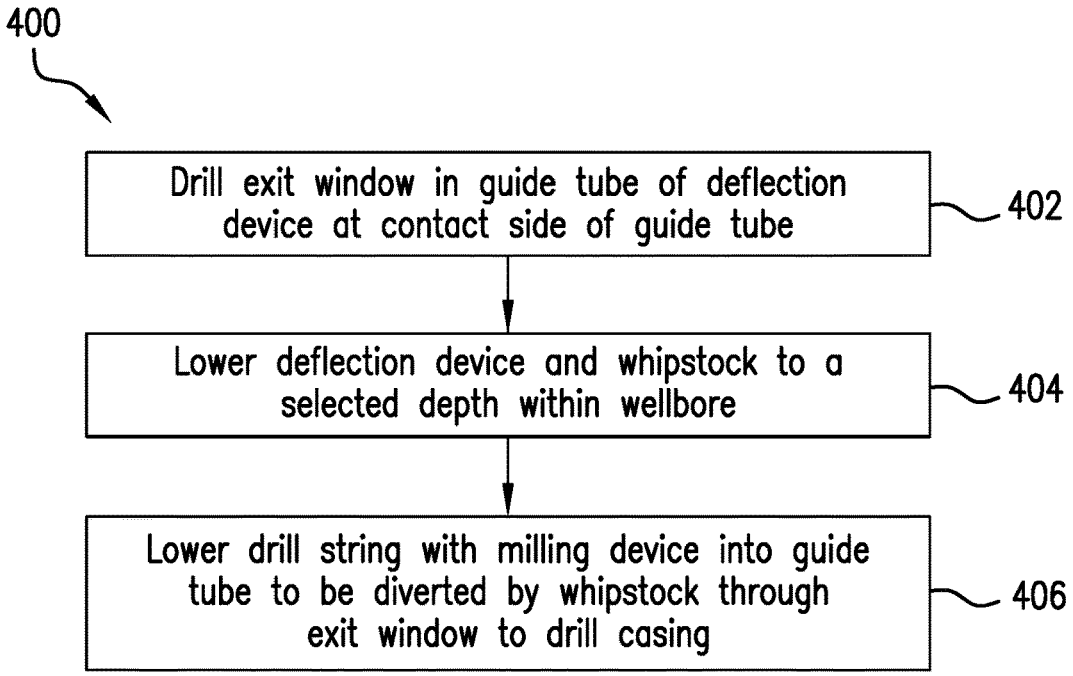
FIG. 4 shows a flowchart illustrating an alternate operation of the eccentric deflection device in various embodiments.

FIG. 4 shows a flowchart 400 illustrating an alternate operation of the eccentric deflection device in various embodiments. In box 402, an exit window 114 is drilled in a contact side of the guide tube at a surface location. In box 404, the eccentric deflection device 100 and whipstock 110 are then conveyed downhole. The eccentric deflection device 100 can be lowered into the wellbore with the whipstock 110 enclosed, or the eccentric deflection device 100 can be lowered into the wellbore first, followed by lowering the whipstock 110 into the eccentric deflection device 100. IN box 406, the drill string and milling device are lowered to the location of the exit window 114 diverted to pass through the exit window 114 to mill the casing 120.

Additionally, once the exit window 114 is drilled in the guide tube, the guide tube 104 can be moved from one target location in the wellbore to another target location. The milling device can thus be used to drill multiple lateral wellbores off of the main wellbore at the different target locations.

Set forth below are some embodiments of the foregoing disclosure:

Embodiment 1: A method of drilling a lateral wellbore off of a main wellbore, including disposing a guide tube of an eccentric deflection device into a casing in the main wellbore with a contact side of the guide tube against the casing, conveying a whipstock through the guide tube to a selected location in the main wellbore for drilling the lateral wellbore, conveying a drill string through the guide tube to the selected location, and directing the drill string via the whipstock to mill an exit window in the contact side of the guide tube and the casing to drill the lateral wellbore.

Embodiment 2: The method as in any prior embodiment, further including offsetting the guide tube from a longitudinal axis of the casing.

Embodiment 3: The method as in any prior embodiment, further including offsetting the guide tube via one or more stabilizers on an exterior surface of the guide tube.

Embodiment 4: The method as in any prior embodiment, further including disposing the eccentric deflection device in the casing with the contact side of the guide tube in contact with the casing, and milling the exit window through the contact side.

Embodiment 5: The method as in any prior embodiment, further including conveying the guide tube to the selected location as an enclosed tube.

Embodiment 6: The method as in any prior embodiment, further including milling the exit window in the guide tube at a surface location and conveying the guide tube and window to the selected location.

Embodiment 7: The method as in any prior embodiment, further including pressing the exit window against the casing.

Embodiment 8: The method as in any prior embodiment, further including orienting the whipstock at the selected location before milling the window.

Embodiment 9: An eccentric deflection device, including a guide tube for guiding a drill string to a selected location in a wellbore, the guide tube supporting a whipstock; and one or more stabilizers configured to maintain the guide tube at an eccentric position in the wellbore.

Embodiment 10: The eccentric deflection device as in any prior embodiment, wherein the stabilizer are opposite a contact side of the guide tube.

Embodiment 11: The eccentric deflection device as in any prior embodiment, wherein the one or more stabilizers maintain a contact side of the guide tube in contact with a casing, wherein the whipstock is oriented in the guide tube to direct a milling device to the contact side.

Embodiment 12: The eccentric deflection device as in any prior embodiment, wherein the guide tube is an enclosed tube when conveyed to the selected location.

Embodiment 13: The eccentric deflection device as in any prior embodiment, wherein the guide tube includes an exit window conveyed to the selected location from a surface location.

Embodiment 14: The eccentric deflection device as in any prior embodiment, wherein the exit window is pressed against a casing at the selected location.

Embodiment 15: The eccentric deflection device as in any prior embodiment, wherein the whipstock is rotatable within the guide tube.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of drilling a lateral wellbore off of a main wellbore, comprising:

disposing a guide tube of an eccentric deflection device into a casing in the main wellbore with a contact side of the guide tube against the casing, the guide tube including two or more stabilizers fastened to an exterior surface of the guide tube opposite the contact side and spaced apart along a longitudinal axis of the guide tube, the stabilizers having a dimension selected to maintain the guide tube at an eccentric position in the wellbore with the contact side against contacting;

conveying a whipstock through the guide tube a selected location in the main wellbore for drilling the lateral wellbore;

conveying a drill string through the guide tube to the selected location; and directing the drill string via the whipstock to mill an exit window in the contact side of the guide tube and the casing to drill the lateral wellbore.

2. The method of claim 1, wherein the two or more stabilizers are fastened to the eccentric deflection device via one of welding, molding and gluing.

3. The method of claim 1, further comprising disposing the eccentric deflection device in the casing with the contact side of the guide tube in contact with the casing, and milling the exit window through the contact side.

4. The method of claim 1, further comprising conveying the guide tube to the selected location as an enclosed tube.

5. The method of claim 1, further comprising orienting the whipstock at the selected location before milling the window.

6. An eccentric deflection device, comprising:

a guide tube for guiding a drill string to a selected location in a wellbore, the guide tube being an enclosed tube having a contact side and supporting a whipstock; and two or more stabilizers fastened onto an exterior surface of the guide tube opposite the contact side and spaced apart along a longitudinal axis of the guide tube, the stabilizers having a dimension selected to maintain the guide tube at an eccentric position in the wellbore with the contact side contacting the casing.

7. The eccentric deflection device of claim 6, wherein the stabilizers are fastened to the guide tube via one of welding, molding and gluing.

8. The eccentric deflection device of claim 6, wherein the two or more stabilizers maintain a contact side of the guide tube in contact with a casing, wherein the whipstock is oriented in the guide tube to direct a milling device to the contact side.

9. The eccentric deflection device of claim 6, wherein the guide tube is an enclosed tube when conveyed to the selected location and the whipstock mills an exit window in the contact side once conveyed in the wellbore.

10. The eccentric deflection device of claim 6, wherein the whipstock is rotatable within the guide tube.

* * * * *